US010113787B2

(12) United States Patent
Claass et al.

(10) Patent No.: US 10,113,787 B2
(45) Date of Patent: Oct. 30, 2018

(54) DOOR TRAY FOR A DOMESTIC REFRIGERATION APPLIANCE WITH A SPECIFIC BASE BODY AND A SEPARATE ADD-ON PART AS WELL AS A DOMESTIC REFRIGERATION APPLIANCE

(71) Applicant: BSH HAUSGERAETE GMBH, Munich (DE)

(72) Inventors: Elena Claass, Geislingen (DE); Max Eicher, Munich (DE); Christoph Becke, Grosskarolinenfeld (DE); Denis Lux, Heidenheim (DE); Boris Angele, Diessen (DE); Andrea Fink, Gerstetten (DE); Christine Hartwein, Nandlstadt (DE); Christian Hoisl, Baierbrunn (DE); Ilja Simon, Dresden (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 15/480,772

(22) Filed: Apr. 6, 2017

(65) Prior Publication Data

US 2017/0292775 A1 Oct. 12, 2017

(30) Foreign Application Priority Data

Apr. 6, 2016 (DE) ..... 10 2016 205 705

(51) Int. Cl.

| | |
|---|---|
| ***F25D 23/04*** | (2006.01) |
| ***F25D 23/02*** | (2006.01) |
| ***F25D 25/02*** | (2006.01) |

(52) U.S. Cl.
CPC ..... *F25D 23/04* (2013.01); *F25D 23/02* (2013.01); *F25D 25/02* (2013.01); *F25D 2400/18* (2013.01)

(58) Field of Classification Search
CPC ..... F25C 23/04; F25D 2400/18; F25D 23/04; F25D 23/02; F25D 23/028
See application file for complete search history.

(56) References Cited

U.S. PATENT DOCUMENTS 5,160,191 A * 11/1992 Holland ..... F25D 23/04 312/321
5,322,366 A * 6/1994 Revlett ..... F25D 23/04 248/221.11

(Continued)

FOREIGN PATENT DOCUMENTS

DE 202008005350 U1 7/2008
DE 102008019261 A1 10/2009

(Continued)

*Primary Examiner* — Kimberley S Wright
(74) *Attorney, Agent, or Firm* — Laurence A. Greenberg; Werner H. Stemer; Ralph E. Locher

(57) ABSTRACT

A door tray for a domestic refrigeration appliance includes a base body for holding stored goods and an add-on part being separate from the base body and fastened to the base body. The base body has an upper bracket that is oriented forward and faces away from a rear wall of the base body and a lower bracket that is disposed at a distance therefrom, is oriented forward and faces away from the rear wall of the base body. The add-on part is fastened to the upper bracket and/or to the lower bracket. A domestic refrigeration appliance with a door tray is also provided.

18 Claims, 7 Drawing Sheets

(56) References Cited

U.S. PATENT DOCUMENTS

| | | | | |
|---|---|---|---|---|
| 5,445,452 | A | 8/1995 | Kauffman | |
| 7,228,612 | B2 * | 6/2007 | Lyvers | 264/177.1 |
| 7,293,846 | B2 * | 11/2007 | Collins | F25D 23/04 220/661 |
| 7,651,182 | B2 * | 1/2010 | Eveland | F25D 23/04 312/405.1 |
| 8,616,665 | B2 * | 12/2013 | Czach | F25D 23/04 312/404 |
| 9,127,878 | B2 * | 9/2015 | Gossens | F25D 25/025 |
| 2003/0020384 | A1 * | 1/2003 | Bush | F25D 25/021 312/348.4 |
| 2004/0011075 | A1 | 1/2004 | Eveland et al. | |
| 2006/0082270 | A1 * | 4/2006 | Collins | F25D 23/04 312/405.1 |
| 2007/0228908 | A1 * | 10/2007 | Eveland | F25D 23/04 312/405.1 |
| 2007/0266543 | A1 * | 11/2007 | Lyvers | 29/527.1 |
| 2009/0039749 | A1 * | 2/2009 | Gerstner | F25D 23/04 312/404 |
| 2010/0109496 | A1 * | 5/2010 | Grasy | F25D 23/04 312/404 |
| 2012/0297816 | A1 * | 11/2012 | Czach | F25D 23/04 62/377 |
| 2014/0062283 | A1 * | 3/2014 | Baldo | F25D 23/04 312/405.1 |
| 2014/0312758 | A1 * | 10/2014 | Gossens | F25D 23/04 312/404 |

FOREIGN PATENT DOCUMENTS

| | | | |
|---|---|---|---|
| DE | 102009028784 | A1 | 2/2011 |
| DE | 102010003839 | A1 | 10/2011 |
| JP | S62143181 | U | 9/1987 |
| WO | 2015079603 | A1 | 6/2015 |

* cited by examiner

DOOR TRAY FOR A DOMESTIC REFRIGERATION APPLIANCE WITH A SPECIFIC BASE BODY AND A SEPARATE ADD-ON PART AS WELL AS A DOMESTIC REFRIGERATION APPLIANCE

CROSS-REFERENCE TO RELATED APPLICATION

This application claims the priority, under 35 U.S.C. § 119, of German Application DE 10 2016 205 705.7, filed Apr. 6, 2016; the prior application is herewith incorporated by reference in its entirety.

BACKGROUND OF THE INVENTION

Field of the Invention

The invention relates to a door tray for a domestic refrigeration appliance, which has a base body configured to hold stored goods in the door tray. The door tray also includes an add-on part that is separate from the base body and fastened to the base body. The invention also relates to a domestic refrigeration appliance with at least one such door tray.

In a domestic refrigeration appliance, which can be for example a refrigerator or a freezer or a combined refrigerator/freezer appliance and is therefore configured to hold food, it is known that a door tray can be disposed on an inner face of a door which closes a receiving space for food. Such door trays are known in a very wide range of shapes and configurations.

A door tray, which is made up of a number of separate parts, is known from German Application DE 10 2008 019 261 A1. Provision is made therein for a trough-type base body to be present, on the upper region of which a U-shaped element can be positioned.

A corresponding configuration is known from German Utility Model DE 20 2008 005 350 U1.

With those known configurations, it is not possible to form a variant of the door tray in a simple manner or with a minimum number of parts. A front region of the door tray cannot be modified, since the container-type single-piece configuration of the base body cannot be modified. Only the upper U-shaped element region can be changed.

A door tray that can be made up of a plurality of separate elements is also known from German Application DE 10 2010 003 839 A1. A connection options for side parts that can be attached to an L-shaped base body and a plate-type front part are complex and assembly is time-consuming. The front face, which is simply in the form of a strip, can only be fastened by way of plug-in connections through the separate side parts, which restricts the reliable positioning of the components in relation to one another.

SUMMARY OF THE INVENTION

It is accordingly an object of the invention to provide a door tray for a domestic refrigeration appliance with a specific base body and a separate add-on part as well as a domestic refrigeration appliance, which overcome the hereinafore-mentioned disadvantages of the heretofore-known devices of this general type, with which variants of at least one front face configuration can be formed more flexibly and simply and with which it is possible to position the required components in a mechanically stable manner in relation to one another and to assemble them simply.

With the foregoing and other objects in view there is provided, in accordance with the invention, a door tray for a domestic refrigeration appliance, comprising a base body, which is configured to hold stored goods. The door tray also includes an add-on part that is separate from the base body and fastened to the base body in a non-destructively releasable manner. One important concept of the invention is that the base body has an upper bracket that is oriented forward in such a manner that it faces away from the rear wall of the base body and a lower bracket disposed at a distance therefrom and oriented forward in such a manner that it faces away from the rear wall of the base body. The add-on part is fastened to the upper bracket and/or to the lower bracket. Such a specific geometry of the base body with two such brackets toward the front face provides the specifically shaped base for configuring multiple variants of the door tray on the front face and allowing a very wide range of add-on parts to be attached there. Such a configuration also means that the add-on part can be fastened more simply and positioned more reliably by using an upper and a lower bracket. A specifically configured base body therefore provides a standard base part, which allows simple fastening of one or more add-on parts or individually different add-on parts thereto, thus making the forming of variants of the front face configuration of the door tray much more flexible.

The upper bracket and/or the lower bracket is/are in particular configured to be curved. A forward orientation in relation to the direction should then be understood to mean that the curve of the rear wall is oriented to face away or the ends of the curved bracket face the rear wall.

In particular, the upper bracket and the lower bracket are disposed parallel to one another and oriented horizontally. In particular, the upper bracket forms an upper termination of the base body, in particular at the front face and side regions. The lower bracket in particular forms a lower termination of the base body and also a front face termination and lateral terminations of the base body. Such configurations of the two brackets mean that the add-on part can easily be attached to at least one of the two brackets from the front. Access to the bracket and ease of operation for fastening an add-on part thereto are therefore achieved in a simple and user-friendly manner.

In particular, the upper bracket is configured to be U-shaped and therefore forms a non-rectilinear strip. This configuration improves the stability of shape and therefore the torsional strength of the upper bracket and also allows the individually shaped add-on part to be fastened both to a front face and also to sides oriented at an angle to the front face. This improves the fastening of the add-on part and makes the positioning of the add-on part on the upper bracket more reliable.

Provision can be made additionally or alternatively for the lower bracket to be configured to be U-shaped. The advantages achieved with this specific shape for the upper bracket apply correspondingly in this case to the lower bracket.

In particular, the U-shape of a bracket defines its forward orientation in relation to the rear wall of the base body, in particular in that an opening of the U-shape faces the rear wall.

The base body preferably has a base so that the stored goods can be positioned thereon and cannot drop out in a downward direction.

The base body is in particular configured or produced as a single piece. It can preferably be made of plastic. Such a configuration minimizes the number of parts required for the base body. It avoids position tolerances of separate parts of a base body in relation to one another and reduces assembly outlay.

Provision can, however, also be made for the upper bracket for example to be configured as a separate part and to be fastened to, for example positioned on or latched to, a separate base part of the base body.

Provision is made in particular for the add-on part to be latched to the upper bracket and/or to the lower bracket. Such a latching connection is simple to configure but still allows the components to be positioned reliably in relation to one another.

Provision can preferably be made for the add-on part to cover the outside of the upper bracket and/or the lower bracket over its surface and/or opaquely. It is thus possible for the add-on part to cover the upper bracket completely both at the front and also at the sides when the door tray is viewed from the front, thereby forming a type of cover or panel of the upper bracket. Provision can be made in this case for the add-on part to be configured to be clear or transparent at least in the region of the upper bracket. However, a translucent or opaque configuration can also be provided.

The add-on part can also be configured as an outside and surface and/or opaque cover at least of one bracket. This configuration of at least one add-on part in relation to the upper bracket and/or the lower bracket gives the door tray a less cluttered appearance from the outside. This also improves the visual impression.

Such covering of at least one bracket by at least one add-on part also protects the respective bracket to a certain degree.

A first add-on part is advantageously configured as a first clasp, which is tailored or adapted to the shape and dimensions of the upper bracket and fastened to the upper bracket so that only the outside of the upper bracket is covered by the clasp. With this embodiment, therefore, a first add-on part is configured as a narrow strip, which therefore has substantially the same dimensions as the upper bracket in the heightwise direction. With this configuration, then only the upper bracket is faced at the front at least in parts, in particular completely, by the clasp. There is no provision in this case for the first clasp to extend excessively beyond the in particular heightwise dimensions of the upper bracket.

In particular, a second add-on part is configured as a second clasp, which is tailored or adapted to the shape and dimensions of the lower bracket and fastened to the lower bracket so that only the outside of the lower bracket is covered by the second clasp. The abovementioned advantages and configurations of a first clasp apply correspondingly to the second clasp in this case.

Provision can be made both for the first clasp to be fastened to the upper bracket and for the second clasp to be fastened to the lower bracket and for an intermediate space or free space between the two brackets and therefore also between the two clasps not to be filled or not to be covered when viewed in a heightwise direction. This allows access to the receiving space in the base body and therefore also to the door tray at the front, through the free space between the brackets and clasps.

In an alternative embodiment provision is made for the add-on part to be a visor, which is fastened to the upper bracket and the lower bracket and which covers a free space when viewed in the heightwise direction between the two brackets. Such an add-on part is then connected in a fixed manner to one of the two brackets respectively both at its upper and lower end when viewed in the heightwise direction. With such a configuration, the visor is preferably clear at least in parts.

Provision can also be made for an add-on to include both the two clasps and also the visor, the two clasps then being disposed on one hand on an upper and on the other hand on a lower edge of an inner face of the visor facing the base body and the entire add-on part being fastened to the base body, in particular to the upper and lower bracket, by way of the two clasps.

The add-on part, which includes the visor and the two clasps, can be configured as a twin-component décor element. The add-on part can be produced by using the twin-component injection molding method. For example, the two clasps can be produced with a first component or as the first component and the visor can then be injection molded onto the two clasps as the second component. Alternatively, it is also possible for the visor to be produced as the first component and for the two clasps then to be injection molded onto the visor as the second component. The material properties, such as for example the opacity or transparency, of the two components preferably differ from one another. A material can also preferably be introduced between the two components. For example, a metal strip can be introduced between the first and second components. A step of introducing the further material, for example the metal strip, then takes place after production of the first component and before injection molding on the second component.

The twin-component injection molding method can advantageously be used to produce the add-on part with opaque and translucent elements/components, giving rise to a single-piece/integral add-on part or an add-on part produced from components connected with a material fit or bonding. Such an add-on part formed from a number of components therefore has no specific latching or other mechanical connecting points to connect the individual components to one another.

The add-on part can be provided with hot stamping and/or printing and/or a metal profile.

Provision can be made for the first clasp and/or the second clasp to be configured as a strip-type décor panel. A clasp can have a different color and/or structure than a region of the base body not covered by the add-on part, so that regions of the door tray that are visibly of a different color and/or different structure can be configured in many ways.

Provision is preferably made for the upper bracket to have a bearing web on at least one bracket segment facing the rear wall of the base body, the bearing web widening toward one end of the bracket segment and being configured to make contact with a counterweb of the add-on part. The bearing web is configured to face away from a receiving space of the door tray and is oriented horizontally outward. The bearing web is in particular also a retaining web or guide web or positioning web for connection to the add-on part. The, in particular, latching connection between the upper bracket and an add-on part is also achieved in a very specific manner as a result. In the assembled end state the relative positions reached are also maintained and secured more effectively.

Provision is made additionally or alternatively for the lower bracket to have a bearing web on at least one bracket segment facing the rear wall of the base body, the bearing web widening toward one end of the bracket segment to make contact with a counterweb of the add-on part. The advantages correspondingly apply in this case.

The upper bracket is preferably configured to be U-shaped in a cross section perpendicular to its longitudinal axis. This makes the bracket extremely rigid. In particular, such a geometric configuration also applies for a lower bracket.

Provision is preferably made for a coupling element, in particular a latching element, to be provided on an outer face of a bracket facing away from the receiving space of the base body. The latching element is provided in particular in the region of an end of the bracket segment. This end is in particular a U-arm of a U-shaped bracket. A latching element on a bracket is therefore preferably configured on an end of the bracket segment facing the rear wall of the base body.

Such a latching element is advantageously an outward projecting angled part, which is configured in particular to be U-shaped. The opening of this U-shape is preferably oriented in the direction of the rear wall of the base body. This allows simple latching and prevents the add-on part from slipping forward relative to the bracket, to which it is fastened.

In particular, with a bracket of the base body on a bracket segment of a preferably U-shaped bracket facing the rear wall of the base body horizontally outward projecting webs, in particular webs widening or spreading toward the end of the bracket segment, are provided respectively on an upper edge and lower edge in the height wise direction. These can both or each individually be configured as bearing webs for making contact with a counterweb of the add-on part. Such a configuration means that a bracket that is U-shaped in its longitudinal extension is also configured to be U-shaped in a cross section perpendicular to its longitudinal extension. Rigidity is increased as a result.

In one advantageous embodiment provision is made for a bearing web on a bracket to extend over the entire length of the bracket, in particular on an upper edge of the bracket and/or on a lower edge of the bracket. Such a bearing web is preferably configured without a break over the entire length of its extension, in particular over the entire length or longitudinal extension of a bracket.

Provision can be made for the lower bracket in particular to have reinforcing braces oriented perpendicular to its longitudinal axis or its longitudinal extension.

In one advantageous embodiment, provision can be made for a base of the base body to be configured to be clear at least in parts. The base in this case can be made of glass. Provision can also be made for the base to be configured as a separate part and also to be disposed on the remaining part of the base body in such a manner that it can be released non-destructively.

In a further embodiment, provision can also be made for the first clasp and the second clasp not to be separate individual add-on parts but to be connected by connecting webs, in particular at the respective ends of the clasps, and to be configured to form a single-piece common add-on part. This reduces the number of parts in embodiments in which both clasps are present as add-on parts, reduces assembly outlay and allows the positional accuracy of the clasps in relation to one another to be improved.

In particular, a free space or slit is provided on an inner face of the add-on part facing the bracket between two webs which extend from the inner face to the bracket, with a web or bearing web of the bracket engaging therein in the assembled state. This improves the mechanical connection between the bracket and the add-on part.

The upper bracket and/or lower bracket preferably has a height in the heightwise direction greater than 1.5 cm, in particular between 1.5 cm and 5 cm, in particular between 2.5 cm and 4 cm. This improves mechanical stability but does not look too bulky. It also means that the receiving space of the base body is not covered by the bracket so that an adequate field of view remains between the brackets, allowing a view into the base body or its receiving region, in particular when the add-on part does not cover the free space between the brackets or when the add-on part covers the free space but is transparent there at least in parts.

With the objects of the invention in view, there is concomitantly provided a domestic refrigeration appliance for holding food, which has a housing, in which a receiving space for the food is provided. The domestic refrigeration appliance also includes at least one door, which is disposed to close the receiving space and in particular is disposed on the housing in such a manner that it can be moved relative to the housing. The domestic refrigeration appliance also includes at least one door tray, which is disposed on an inner face, which faces the receiving space when the door is in the closed state. The domestic refrigeration appliance can, for example, be a refrigerator or a freezer or a combined refrigerator/freezer appliance.

The terms "above," "below," "front," "rear," "horizontal," "vertical," "depthwise direction," "widthwise direction," "height wise direction," etc., refer to positions and orientations applicable when the door tray and appliance are used and disposed in the correct manner and when an observer is standing in particular in front of the door tray or appliance and looking in the direction of the door tray or appliance.

Further features of the invention will emerge from the claims, figures and description of the figures. The features and feature combinations cited above in the description and the features and feature combinations cited below in the description of the figures and/or simply illustrated in the figures can be used in other combinations as well as the combination specified in each instance, without departing from the scope of the invention. Embodiments of the invention which are not illustrated and described specifically in the figures but emerge and can be produced from the described embodiments as a result of separate feature combinations should therefore also be considered to be included and disclosed. Embodiments and feature combinations which therefore do not exhibit all the features of an originally formulated independent claim should also be considered to be disclosed. Also, embodiments and feature combinations which go beyond or deviate from the feature combinations set out in the claim references should also be considered to be disclosed, in particular by the embodiments set out above.

Other features which are considered as characteristic for the invention are set forth in the appended claims.

Although the invention is illustrated and described herein as embodied in a door tray for a domestic refrigeration appliance with a specific base body and a separate add-on part as well as a domestic refrigeration appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 with the components in the assembled state;

DETAILED DESCRIPTION OF THE INVENTION

Figure 1:
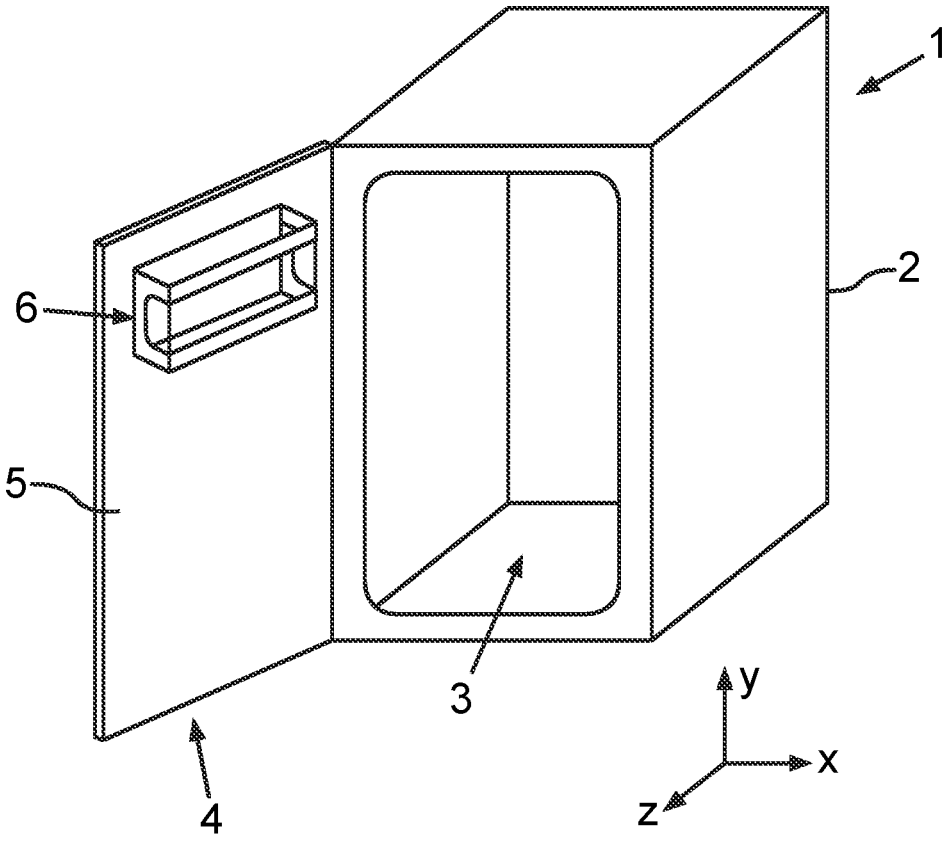
FIG. 1 is a diagrammatic, perspective view of an exemplary embodiment of an inventive domestic refrigeration appliance.

Referring now in detail to the figures of the drawings, in which identical elements or those of identical function are shown with the same reference characters, and first, particularly, to FIG. 1 thereof, there is seen a diagrammatic view of a domestic refrigeration appliance 1, which is configured to store and conserve food. The domestic refrigeration appliance 1 can, for example, be a refrigerator or a freezer or a combined refrigerator/freezer appliance. The domestic refrigeration appliance 1 includes a housing 2, in which at least one receiving space 3 for food is configured. The domestic refrigeration appliance 1 also includes a door 4, which is disposed in a pivotable manner on the housing 2 and is provided to close the receiving space 3. A door tray 6 is disposed on an inner face 5 of the door 4 in the exemplary embodiment, in which the number and position thereof is only shown by way of example therein.

Figure 2:
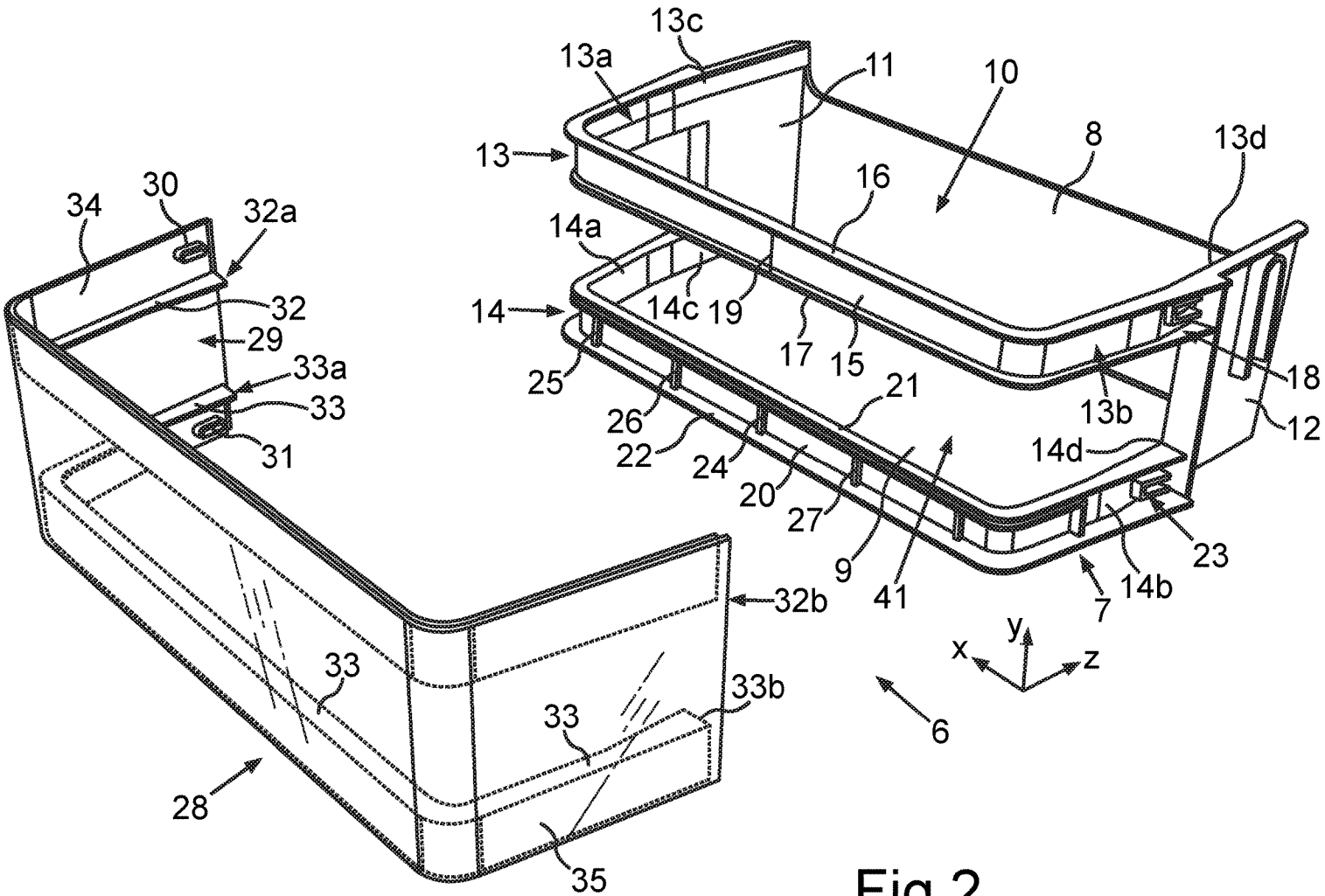
FIG. 2 is an exploded perspective view of an exemplary embodiment of an inventive door tray.

FIG. 2 shows a perspective view of an exemplary embodiment of a door tray 6. The door tray 6 includes a base body 7, which is made of plastic as a single piece in the illustrated embodiment. The base body 7 includes a rear wall 8 and a base 9 adjoining thereto. The base body 7 also includes a receiving region 10, into which the food, for example foodstuffs and beverages, can be introduced. The base body 7 per se is therefore already configured to hold food.

The base body 7 also includes side walls 11 and 12 on opposing sides, which are connected to both the rear wall 8 and the base 9.

The base body 7 also has an upper bracket 13 and a lower bracket 14, which is disposed at a distance therefrom in the heightwise direction and therefore in the y-direction. The upper bracket 13 and the lower bracket 14 in this case are each configured as curved, in particular U-shaped, and extend in particular parallel to one another and in horizontal planes when viewed in relation to their longitudinal extension. The bracket 14 extends from the plane of the base 9 upward.

The upper bracket 13 includes opposing bracket segments 13*a* and 13*b* having ends 13*c* and 13*d* which run into a front edge of the side walls 11 and 12. The bracket segments 13*a* and 13*b* are thus oriented in the direction of the rear wall 8 and end at a distance from the rear wall 8. The same provision is also made for the lower bracket 14, which has opposing bracket segments 14*a* and 14*b* with related ends 14*c* and 14*d*. The ends 14*c* and 14*d* also run into a front edge, which faces away from the rear wall 8, of the side walls 11 and 12. The lower bracket 14 is also connected to the base 9, in particular over its entire extension along the U-shape or its entire length.

The upper bracket 13 forms an upper termination of the base body 7 in the heightwise direction (y-direction), and as a whole the lower bracket 14 forms a lower termination of the base body 7.

The upper bracket 13 is in particular also U-shaped over its entire length in a cross section perpendicular to its longitudinal extension. Thus, an upper web 16 is configured on a center arm 15 of the U-shape on an upper edge, extending outward and therefore facing away from the receiving space 10. A lower web 17 is also shaped on the center arm 15, and is also directed outward and therefore is configured to face away from the receiving space 10. Both webs 16 and 17 are formed without a break over the entire length of the upper bracket 13 and therefore also over the entire length of the center arm 15. The webs 16 and 17 each also at least partially form a bearing web for an add-on part. It can also be seen that the upper web 16 is configured to widen or become larger in the region of the bracket segment 13*a* and also in the region of the bracket segment 13*b*, in particular toward the ends 13*c* and 13*d*. The same provision is also made for the lower web 17.

A latching element is configured on an outer face of the center arm 15 facing away from the receiving space 10, adjacent each of the ends 13*c* and 13*d*, although only one latching element 18 is shown in FIG. 2. The latching element 18 is an outwardly raised part, which is configured in particular as U-shaped in the illustrated embodiment, with the opening of the U-shape being oriented toward the rear wall 8.

A vertical centering web 19 is also configured in a front part of the upper bracket 13 connecting the bracket segments 13*a* and 13*b*, extending over the entire height of the center arm 15 between the upper web 16 and the lower web 17. This improves centering or reliability when positioning an add-on part fastened to the base body 7.

As is shown in the view of the example in FIG. 2, the lower bracket 14 also has a center arm 20, an upper web 21 and a lower web 22. In this case too, the webs 21 and 22 are configured without a break in particular over their entire length and extend in particular over the entire length of the lower bracket 14. The webs 21 and 22 are also oriented horizontally outward and thus facing away from the receiving space 10, so that the lower bracket 14 is also configured as U-shaped in a section perpendicular to its longitudinal extension.

The webs 21 and 22 are also configured at least partially in this case as bearing webs for an add-on part to be fastened to the base body 7.

Provision is also made in this case in particular for the webs 21 and 22 to be configured as widening or spreading in the region of the bracket segments 14*a* and 14*b* and in particular toward the ends 14*c* and 14*d*, as shown in FIG. 2, thereby achieving the greatest surface contact possible with a counterweb at the ends and improving the mechanical stability of the connection as well as allowing the components to be positioned precisely.

A latching element is also configured in this case on an outer face of the center arm 20 adjacent each of the ends 14*c* and 14*d*, with only a latching element 23 being shown in FIG. 2. The latching element 23 is also preferably U-shaped and oriented with the opening of the U-shape in the direction of the rear wall 8.

A corresponding positioning web 24 is also provided in this case. Further webs 25, 26, 27 (only some of which are assigned reference characters for the sake of clarity) are also provided and extend vertically on an outer face of the center arm 20 and in particular between the upper web 21 and the lower web 22. These additional webs 25 to 28 make the base body 7 rigid, in particular in the region of the base 9 with the lower bracket 14.

In the embodiment illustrated in FIG. 2 an add-on part 28 is shown which is separate from the base body 7. The add-on part 28 is also U-shaped and forms a visor, which means that a free space between the brackets 13 and 14 is covered by it at the front. The add-on part 28 is configured for latching to the base body 7, with provision being made in this case for latching to the upper bracket 13 and the lower bracket 14. To this end the add-on part 28 includes latching elements 30 and 31 on an inner face 29 facing the brackets 13 and 14, as well as a further two corresponding latching elements (not shown in FIG. 2) on the opposing free arm of the U-shape. These latching elements 30 and 31 then latch into the corresponding latching elements 18 and 23 on the brackets 13 and 14.

An inward projecting counterweb 32 and a further counterweb 33 configured at a distance therefrom and running parallel thereto are also provided on this inner face 29. The webs 32 and 33 also preferably extend without a break over the entire length of the add-on part 28, with the length being measured along the U-shape.

It can also be seen there that the counterwebs 32 and 33 widen or spread toward their free ends 32*a* and 33*a* or 32*b* and 33*b*. When the add-on part 28 is in the assembled state on the base body 7, the lower counterweb 33 rests on the upper web 21. The upper counterweb 32 also rests on the lower web 17 of the upper bracket. A certain amount of guidance is therefore provided by the counterwebs 32 and 33 and the contact with the webs 21 and 17, so that the end position can be easily reached and the latching of the add-on part 28 to the base body 7 can be achieved in a simple manner.

Provision is made in particular for the add-on part 28 to be configured as at least partially transparent and therefore clear. In the embodiment illustrated herein a non-transparent strip 34 or 35 is provided both in the upper region of the add-on part 28 and in the lower region of the add-on part 28. The strips 34 and 35 preferably have a height (extension in y-direction) which corresponds to the height of the brackets 13 and 14. When the add-on part 28 is in the assembled state on the base body 7, the brackets 13 and 14 are therefore completely concealed by the strips 34 and 35 when viewed from the outside.

Figure 3:
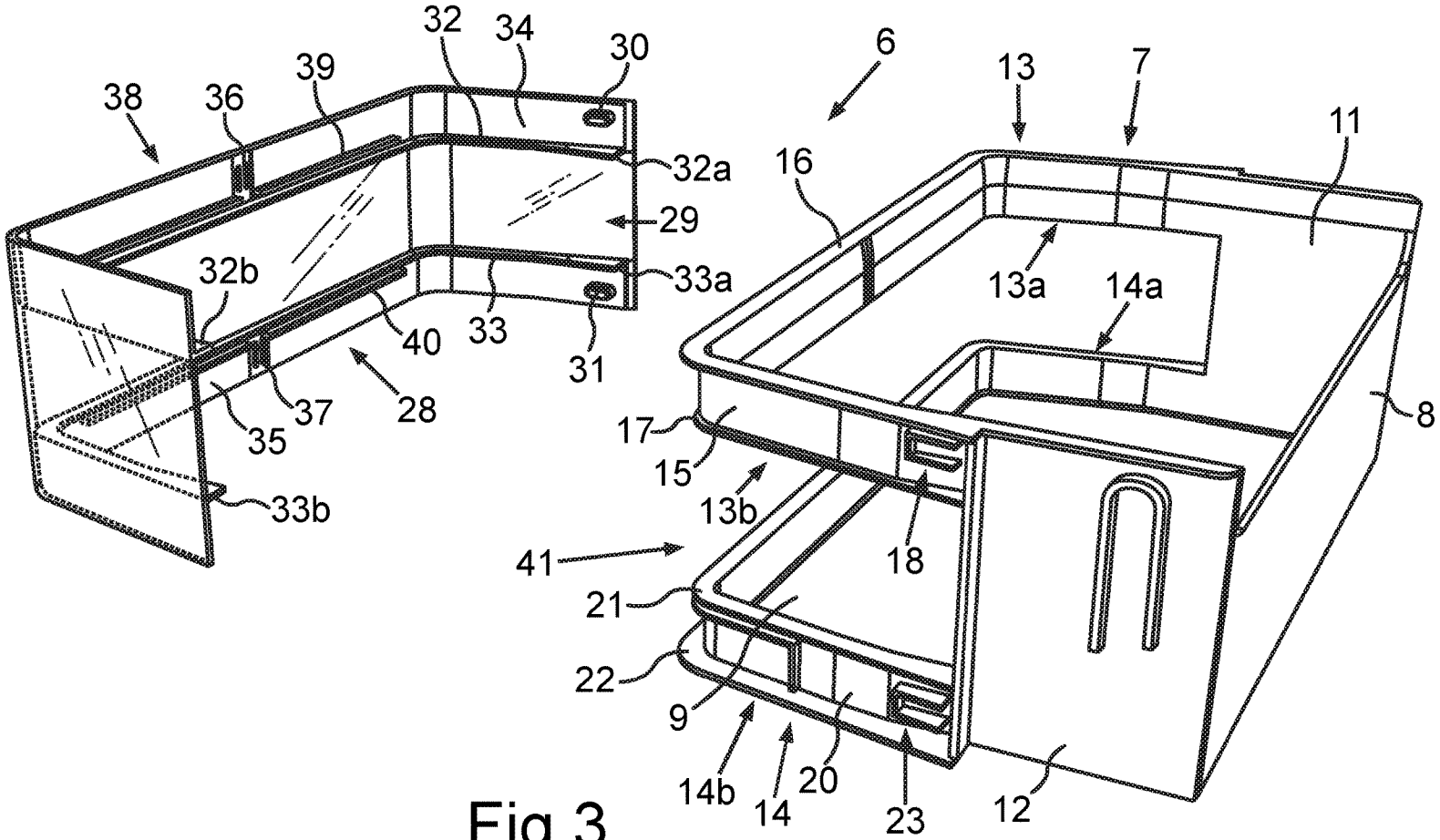
FIG. 3 is an exploded view of the components according to FIG. 2 in a different perspective from the one shown in FIG. 2.

FIG. 3 shows a further perspective view of the door tray 6 according to FIG. 2. Holders 36 and 37 on the add-on part 28, in which the positioning webs 19 and 24 engage, can be clearly seen.

In one advantageous embodiment provision is also made on the add-on part 28 for a further web 39 to be provided on the inner face 29 parallel to and at a distance from the counterweb 32 on a front element 38 of the add-on part 28. The distance in the heightwise direction and therefore in the y-direction between the counterweb 32 and the further web 39 is in particular formed in such a manner that the lower web 17 of the upper bracket 13 can engage therein. As a result, the lower web 17 is then held or clamped in between, from above by the web 39 and from below by the counterweb 32, since the slit or free space between the web 39 and the counterweb 32 specifically allows engagement, in particular close engagement.

Provision is also advantageously made for this clamping for the upper web 21 of the lower bracket 14. To this end a further separate web 40 is configured on the inner face 29 at a distance from and parallel to the lower counterweb 33. The distance in the heightwise direction between the lower counterweb 33 and the further web 40 is also formed in such a manner that the upper web 21 of the lower bracket 14 can engage with a close fit.

The configuration and positioning of the brackets 13 and 14 mean that a free space 41 is provided between the brackets 13 and 14, which is then closed by the add-on part 28.

Figure 4:
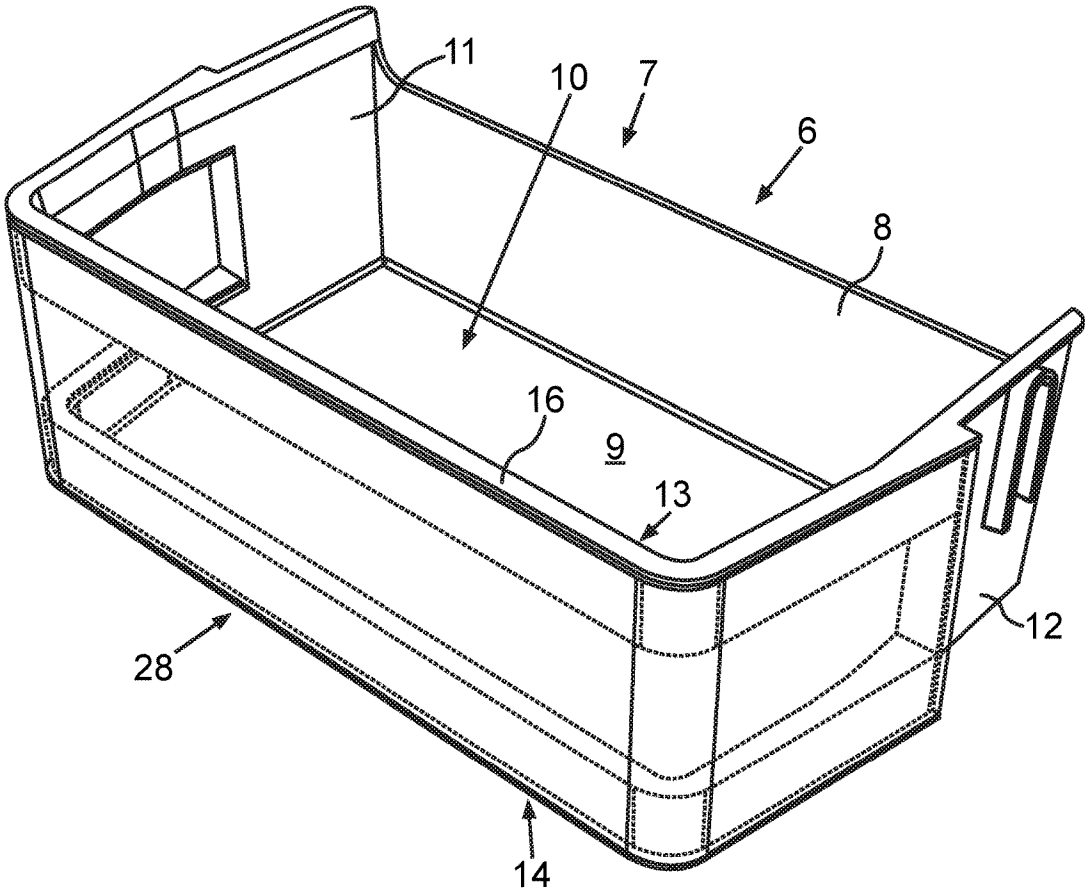
FIG. 4 is a perspective view of the door tray according to FIG. 2.

FIG. 4 shows a perspective view of the door tray 6, with the add-on part 28 shown on the base body 7 in the assembled position. It can be seen clearly that the add-on part 28 extends over a height which corresponds to the height between the upper web 16 of the upper bracket 13 and the lower web 22 of the lower bracket 14. The add-on part 28 also has a length (measured in the x-z-plane), which corresponds to the length of the upper bracket 13 and also the length of the lower bracket 14.

Figure 5:
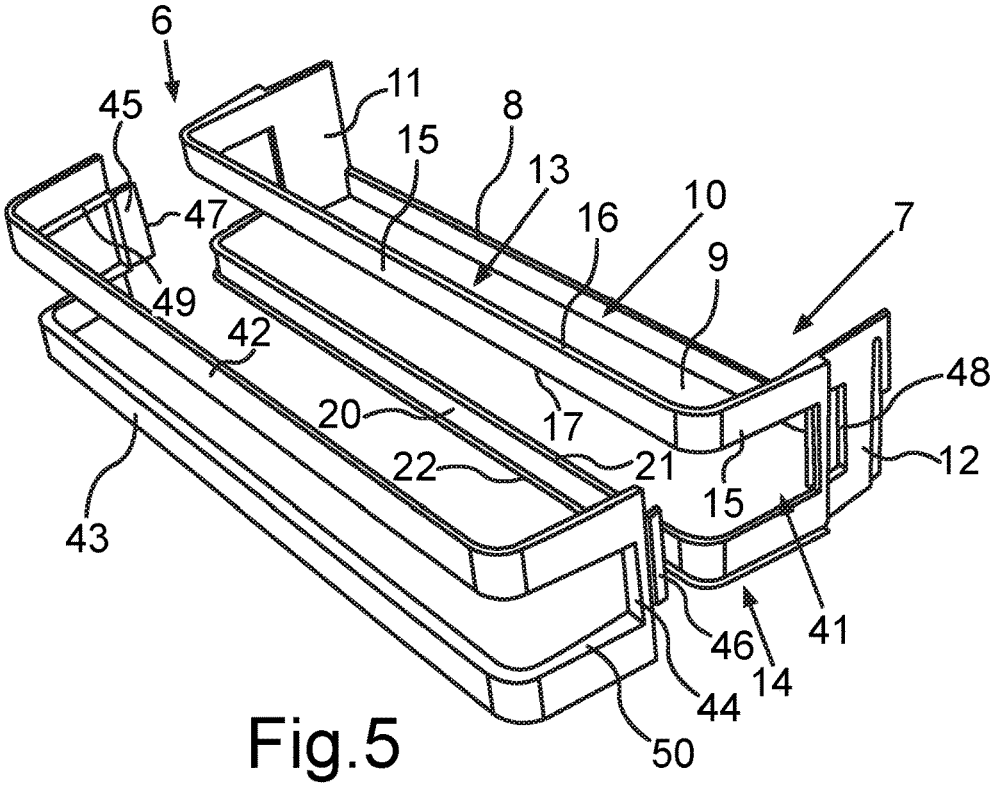
FIG. 5 is a perspective view of a further exemplary embodiment of an inventive door tray with a base body and add-on part in the separated state.

FIG. 5 shows a perspective view of a further exemplary embodiment of a door tray 6. In this embodiment, the add-on part 28 is not formed in the manner of a full visor, as in FIG. 2 to FIG. 4, but is formed from a first clasp 42 and a second clasp 43. The two clasps 42 and 43 are formed as curved strips, in particular U-shaped strips. They each have a height which corresponds to the corresponding height of the upper bracket 13 or the lower bracket 14. This means that the first add-on part configured as the first clasp 42 conceals the upper bracket 13 completely in the assembled state. The second add-on part configured as the second clasp 43 similarly conceals the outside of the lower bracket 14 in the assembled state.

In the embodiment shown therein provision is made for the ends of the two clasps 42 and 43 to be connected to connecting parts 44 and 45, so that the two clasps 42 and 43 are configured as a single piece with the connecting elements 44 and 45, thereby forming a single-piece complete add-on part. In particular, latching elements 46 and 47, which are provided on the connecting elements 44 and 45, latch into latching holders on the base body 7, in particular on the side walls 11 and 12. The latching holder 48 is shown therein by way of example.

Figure 6:
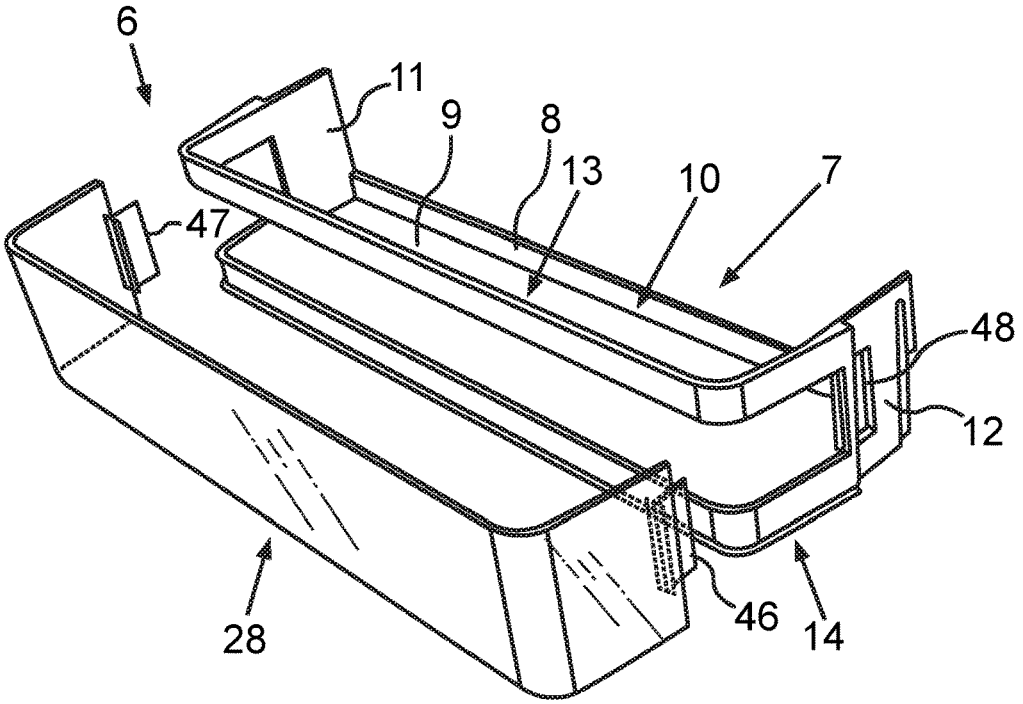
FIG. 6 is a further perspective view of an exemplary embodiment of an inventive door tray with a base body and a separate add-on part.

FIG. 6 shows a further exemplary embodiment of an alternative configuration of a door tray 6. In contrast to the configuration according to FIG. 5, the add-on part 28 is configured differently in this case. The base body 7 is formed according to the configuration in FIG. 5. In this embodiment, the add-on part 28 is again configured as a visor and in this instance as totally transparent. The add-on part 28 with its single-piece configuration extends again over the entire height between the upper web 16 of the upper bracket 13 and the lower web 22 of the lower bracket 14.

Figure 7:
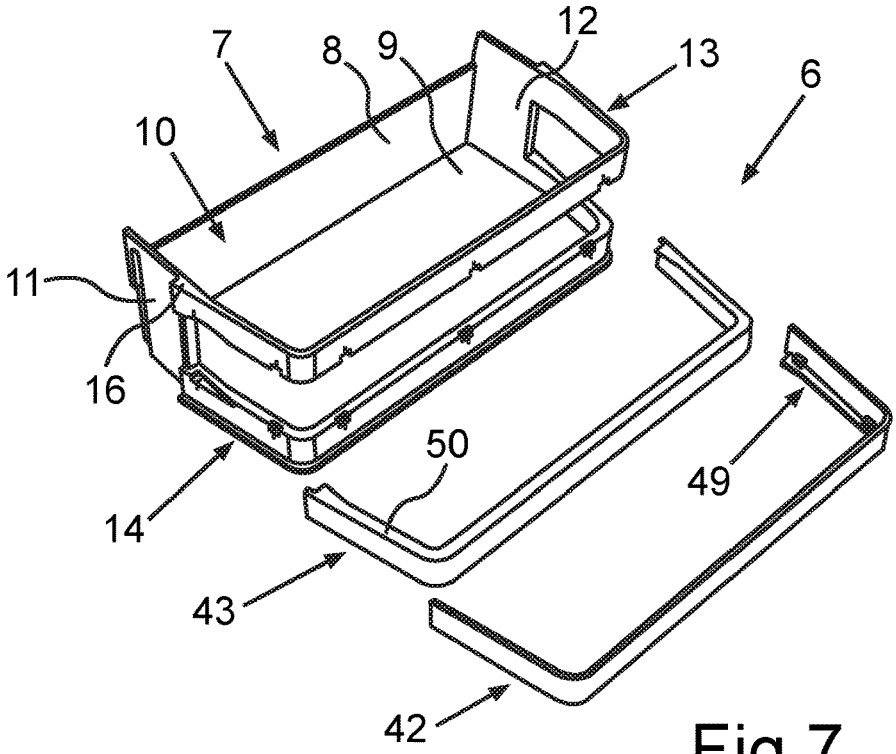
FIG. 7 is a perspective view of a further exemplary embodiment of an inventive door tray with two separate add-on parts configured as clasps.

FIG. 7 shows a further perspective view of an exemplary embodiment of a door tray 6. In this embodiment, two separate add-on parts are provided as the first clasp 42 and the second clasp 43, which are separate in this case and not configured, as in FIG. 5, as a common complete add-on part.

The clasp 42 in this case also has a counterflange 49, which in the assembled state on the upper bracket 13 makes contact with the web 17, which forms a bearing web in this case. It also shows that the configuration widens or spreads toward the free end. The web 17 may also not be present in this case. The second clasp 43 also has a corresponding counterweb 50.

Figure 8:
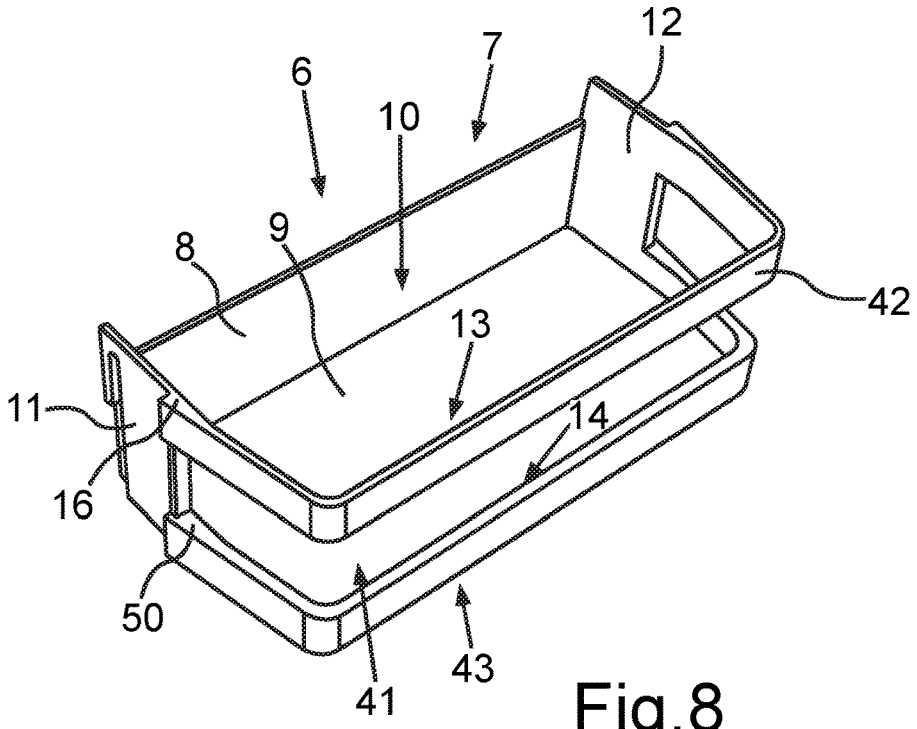
FIG. 8 is a perspective view showing the configuration of the door tray according to FIG. 7 with the components in the assembled state.

FIG. 8 shows the assembled state of the clasps 42 and 43 on the base body 7, in particular the upper bracket 13 and the lower bracket 14.

Figure 9:
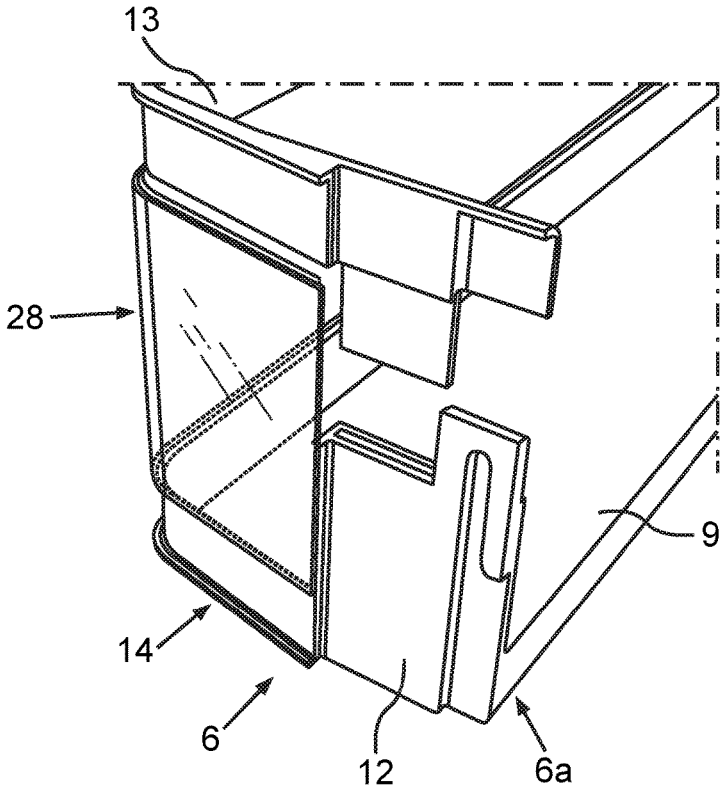
FIG. 9 is a fragmentary, perspective view of a further exemplary embodiment of an inventive door tray with a separate upper bracket of the base body.

FIG. 9 shows a fragmentary, perspective view of a further exemplary embodiment of a door tray 6. In this embodiment provision is made for the base body 7 not to be configured as a single piece but as multiple pieces and to have a base part 6*a*. In the illustrated embodiment, the upper bracket 13, which is a separate part in this case, can be fastened to, in particular positioned on, the base part 6*a*.

Figure 10:
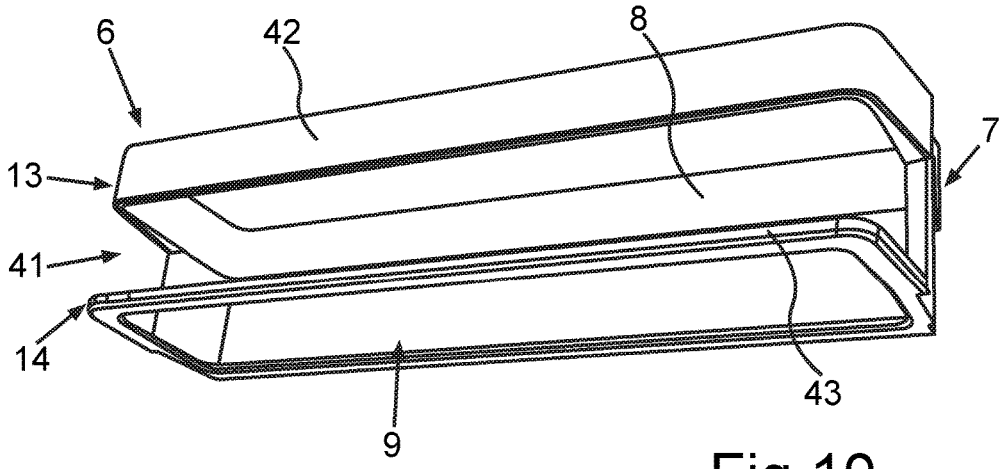
FIG. 10 is a perspective view of a further exemplary embodiment of an inventive door tray in the assembled end state.

FIG. 10 shows a perspective view of a further exemplary embodiment of a door tray 6. It can be seen clearly in this case that the base 9 is configured as at least partially transparent. Provision can be made for the transparent region to be made of glass. Provision can also be made for the transparent element to be disposed in a non-destructively releasable manner on the further base part of the base body 7, so that it can also be removed and replaced correspondingly. In this embodiment provision is made for an add-on part to be configured as a clasp 42, which is fastened to the upper bracket 13, covering it at the front. The lower bracket 14 is also covered by a corresponding clasp 43. In this embodiment, as in the embodiments according to FIG. 5 and FIG. 8, the free space 41 is then open and therefore also accessible from the side or front or allows access through up to the receiving space 10.

In the exemplary embodiments, the upper bracket 13 and/or the lower bracket 14 preferably has/have a height in the heightwise direction (y-direction), which is preferably between 1.5 cm and 5 cm, in particular between 2.5 cm and 4 cm. This is the height of a bracket 13 and/or 14 over its entire longitudinal extension, in particular the height of a bracket 13 and/or 14 is constant over its entire longitudinal extension.

The invention claimed is:

1. A door tray for a domestic refrigeration appliance, the door tray comprising:

a base body for holding stored goods, said base body defining a forward direction, and said base body including a rear wall, an upper bracket oriented in said forward direction and facing away from said rear wall and a lower bracket disposed at a distance from said upper bracket, oriented in said forward direction and facing away from said rear wall;

at least one of said upper bracket or said lower bracket having a U-shaped extent defined by a center arm with a longitudinal extent in a longitudinal direction of said rear wall and by a respective bracket segment at each end of said center arm, each directed toward said rear wall; and an add-on part being separate from said base body, said add-on part being fastened to at least one of said upper bracket or said lower bracket of said base body.

2. The door tray according to claim 1, wherein said upper bracket forms an upper front face termination of said base body.

3. The door tray according to claim 1, wherein said lower bracket forms a lower front face termination of said base body.

4. The door tray according to claim 1, wherein said base body has a base.

5. The door tray according to claim 1, wherein said base body is formed as a single piece.

6. The door tray according to claim 1, wherein said add-on part is latched to at least one of said upper bracket or said lower bracket.

7. The door tray according to claim 1, wherein said upper bracket and said lower bracket each have an outer surface, and said add-on part covers or opaquely covers said outer surface of at least one of said upper bracket or said lower bracket.

8. The door tray according to claim 1, wherein said add-on part includes a first clasp matching a shape and dimensions of said upper bracket, being fastened to said upper bracket and covering only an outside of said upper bracket.

9. The door tray according to claim 8, wherein said add-on part includes a second clasp matching a shape and dimensions of said lower bracket, being fastened to said lower bracket and covering only an outside of said lower bracket.

10. The door tray according to claim 1, wherein said add-on part is a visor being fastened to said upper bracket and to said lower bracket and covering a free space between said upper bracket and said lower bracket.

11. The door tray according to claim 1, wherein:

said add-on part has a counterweb;

said upper bracket has at least one bracket segment facing said rear wall;

said at least one bracket segment has ends;

said upper bracket has a bearing web on said at least one bracket segment; and said bearing web widens toward one of said ends of said bracket segment to make contact with said counterweb of said add-on part.

12. The door tray according to claim 1, wherein:

said add-on part has a counterweb;

said lower bracket has at least one bracket segment facing said rear wall;

said at least one bracket segment has ends;

said lower bracket has a bearing web on said at least one bracket segment; and said bearing web widens toward one of said ends of said bracket segment to make contact with said counterweb of said add-on part.

13. The door tray according to claim 11, wherein:

said lower bracket has at least one bracket segment facing said rear wall;

said at least one bracket segment has ends;

said lower bracket has a bearing web on said at least one bracket segment; and said bearing web widens toward one of said ends of said bracket segment to make contact with said counterweb of said add-on part.

14. The door tray according to claim 1, wherein:

one of said brackets has a bearing web;

said add-on part has an inner face facing said base body;

said add-on part has a counterweb on said inner face and a further web on said inner face parallel to said counterweb; and said counterweb and said further web form a free space therebetween in a heightwise direction for engagement of said bearing web of said bracket.

15. The door tray according to claim 1, wherein said add-on part has a shape matched to said U-shaped extent of at least one of said upper bracket or said lower bracket.

16. The door tray according to claim 1, wherein said add-on part has a longitudinal extent matched to a shape of at least one of said upper bracket or said lower bracket.

17. A domestic refrigeration appliance, comprising:

a housing;

a receiving space in said housing for receiving food;

a door for closing said receiving space, said door having an inner face; and at least one door tray according to claim 1 disposed on said inner face of said door.

18. The door tray according to claim 1, wherein said center arm has a U-shaped cross section opening in a direction away from said rear wall.

* * * * *